United States Patent [19]

Nelson

[11] Patent Number: 5,044,386

[45] Date of Patent: Sep. 3, 1991

[54] PORTABLE DENTAL CARE UNIT

[76] Inventor: Gary M. Nelson, 1324 SE 23rd St., Cape Coral, Fla. 33990

[21] Appl. No.: 519,162

[22] Filed: May 4, 1990

[51] Int. Cl.[5] ..... A45D 44/18

[52] U.S. Cl. ..... 132/309; 132/324; 401/123; 401/125; 401/269

[58] Field of Search ..... 132/308, 309, 311, 312, 132/324; 401/123, 124, 125, 134, 135, 269, 286; 15/167.1

[56] References Cited

U.S. PATENT DOCUMENTS

| | | | |
|---|---|---|---|
| 1,339,265 | 5/1920 | Levitan | 401/124 |
| 1,473,766 | 11/1923 | Healy | 132/309 |
| 2,233,522 | 3/1941 | Fickle | 132/309 |
| 2,284,217 | 5/1942 | Lieberthal | 132/308 |
| 2,306,482 | 12/1942 | Livingston | 15/167.1 |
| 2,310,571 | 2/1943 | Brady | 401/124 |
| 2,379,600 | 7/1945 | Smith et al. | 132/311 |
| 2,391,371 | 12/1945 | Watt | 401/124 |
| 2,438,641 | 3/1948 | Loehr | 401/123 |
| 2,455,600 | 12/1948 | Molumby et al. | 401/124 |
| 2,459,285 | 1/1949 | Murphy | 132/311 |
| 2,468,733 | 5/1949 | Boulicault | 132/311 |
| 2,484,627 | 10/1949 | Lennox | 132/308 |
| 2,601,244 | 6/1952 | Boulicault | 132/309 |
| 2,640,488 | 6/1953 | Velodota | 132/308 |
| 2,733,722 | 2/1956 | Rodd | 401/124 |
| 2,868,215 | 1/1959 | Mechem | 401/123 |
| 2,962,032 | 11/1960 | Reuter | 401/124 |
| 4,408,920 | 10/1983 | Walther et al. | 401/269 |
| 4,527,574 | 7/1985 | Manfredi | 132/308 |
| 4,919,156 | 4/1990 | Gipson | 132/309 |

FOREIGN PATENT DOCUMENTS

| | | | |
|---|---|---|---|
| 246961 | 9/1960 | Australia | 401/124 |
| 970819 | 1/1951 | France | 401/125 |
| 417376 | 1/1947 | Italy | 401/269 |
| 252327 | 9/1948 | Switzerland | 401/269 |
| 358064 | 12/1961 | Switzerland | 401/124 |

*Primary Examiner*—John J. Wilson
*Assistant Examiner*—Frank A. LaViola
*Attorney, Agent, or Firm*—William E. Noonan

[57] ABSTRACT

A portable dental care unit is disclosed, including an upper piece and a lower piece. The upper piece has a head portion and bristles which are attached to, and extend generally laterally from the head portion. A base of the upper piece is selectively attached to the lower piece such that the lower piece forms a handle for the toothbrush apparatus. An intermediate portion interconnects the head portion and the base portion and includes a recessed region formed below the bristles. The lower piece has a receptacle for accommodating a first dentifrice therein. A container is received by the recessed region for holding a second dentifrice therein. A closure is selectively engaged with the toothbrush apparatus for provisionally enclosing at least the head portion and the bristles of the upper piece between uses.

20 Claims, 2 Drawing Sheets

PORTABLE DENTAL CARE UNIT

FIELD OF THE INVENTION

This invention relates to a portable dental care unit which is particularly suitable for use by the traveler who is away from home.

BACKGROUND OF THE INVENTION

A number of travel toothbrush units have been developed. See for example Taylor, U.S. Pat. No. 2,807,818, Manfredi, U.S. Pat. No. 4,527,574, Clark, U.S. Pat. No. 4,275,750 and Roth, Swiss Patent No. 246,842. Typically, these devices employ a removable cover or cap for enclosing the toothbrush between uses. As illustrated by several of the above references, these caps may include a clip to secure the unit to the user's pocket in a manner similar to a pen. Often, the handle of the apparatus is used to store toothpaste or other dentifrice, which is to be applied to the toothbrush. However, the previously known dental units have been limited to carrying a single dentifrice.

In recent years, increased concern for dental care has caused a demand for a large number of dental care products, including various toothpastes, gels, mouthwashes, rinses and dental flosses. Unfortunately, however, none of the portable dental units which are currently known are capable of carrying at least two types of dentifrices plus dental floss. Moreover, none of these apparatuses provides storage for a rinse or gargle. As a result, the typical traveler must separately pack and carry two or more different dental items. This can be inefficient, messy and annoying.

SUMMARY OF INVENTION

It is therefore an object of this invention to provide an improved portable dental care unit which uniquely allows at least two dentifrices to be stored at any one time with a toothbrush in a single unit.

It is a further object of this invention to provide a portable dental care appliance which is capable of conveniently accommodating a toothbrush, a rinse or gargle, at least one additional dentifrice and a supply of dental floss, within a single unit.

It is a further object of this invention to provide a portable, lightweight and compact dental care unit which may be conveniently transported and stored either in the traveler's luggage or pocket and which is readily and conveniently assembled for use.

It is a further object of this invention to provide a portable dental unit which conveniently stores a liquid rinse or gargle during travel without leaking.

It is a further object of this invention to provide a portable dental care unit which dries quickly and is hygienically safe.

This invention results from a realization that a more efficient, compact and versatile portable dental care unit may be achieved by accommodating a dentifrice container within a recessed region of the toothbrush immediately adjacent to the bristles. For example, a container which provides one or more applications of toothpaste may be stored within the recessed region. This allows a receptacle within the handle of the toothbrush apparatus to be utilized for storing a rinse or gargle. Such mouth rinses have not heretofore been employed in conventional portable dental care apparatuses.

Accordingly, applicant's invention features a portable dental care unit which includes a toothbrush apparatus having an upper piece and a lower piece. The upper piece has a head portion and bristle means which are attached to, and extend generally laterally from the head portion. A base portion includes means for selectively attaching to complementary means on the lower piece, such that the lower piece forms a handle for the toothbrush apparatus. There is an intermediate portion which interconnects the head portion and the base portion and includes a recessed region formed below the bristle means. The lower piece further has a receptacle for accommodating a first dentifrice therein. A container is received by the recessed region for holding a second dentifrice therein. Closure means are selectively engaged with the toothbrush apparatus for provisionally enclosing at least the head portion and the bristle means of the upper piece between uses.

In a preferred embodiment, the intermediate portion may further include means formed below the recessed region for supporting a supply of dental floss on the upper piece. The means for supporting may include a peripheral spool formed in the intermediate portion and about which the floss is wound. The intermediate portion may further include notch means for securing one end of the floss therein. The intermediate portion may include a pair of enlarged peripheral segments formed above and below the spool for engaging the inside wall of the closure means when the closure means are engaged with the toothbrush apparatus. The means for selectively connecting may include first thread means formed on the base and the complementary means may include second thread means formed on an upper end of the lower piece and being engagable with the first thread means to attach the lower piece to the upper piece. The lower piece may include an open upper end for selectively receiving the base of the upper piece. The base may include first thread means that are formed peripherally thereon and the open upper end may include second thread means formed therein for engaging the first thread means to attach the lower piece to the upper piece.

The closure means may include an opening for receiving the upper piece. The lower piece may include an upper end which is slidably receivable in the opening of the closure means and is engagable with the closure means to provisionally hold the closure means onto the toothbrush apparatus. The lower piece may include rib means for engaging the closure means to limit advancement of the closure means onto the lower piece. Seal means may be disposed between the upper and lower pieces for restricting the first dentifrice from leaking from the receptacle.

The recessed region may include means for retaining the container therein. The container may include a discharge portion and a chamber for accommodating a toothpaste. Plunger means may be manually drivable through the chamber to urge the toothpaste out the discharge portion onto the bristles. The plunger means may include a plunger head that is slidably receivable in the chamber and a handle portion which is attached to the plunger head and extends out of the container. The handle portion may be engaged to drive the plunger head through the chamber. Means may be provided for holding the container in place in the recessed region. Such means may include slot means for receiving the handle portion of the plunger means. Alternatively, the container may include a disposable single use toothpaste packet.

An absorbent sheath may be utilized for holding the entire unit and absorbing moisture therefrom. The closure means may include orifice means for providing ventilation to the head portion to assist in drying the toothbrush apparatus.

DETAILED DESCRIPTION OF PREFERRED EMBODIMENT

Other objects, features and advantages will occur from the following description of preferred embodiments and the accompanying drawings, in which.

Figure 1:
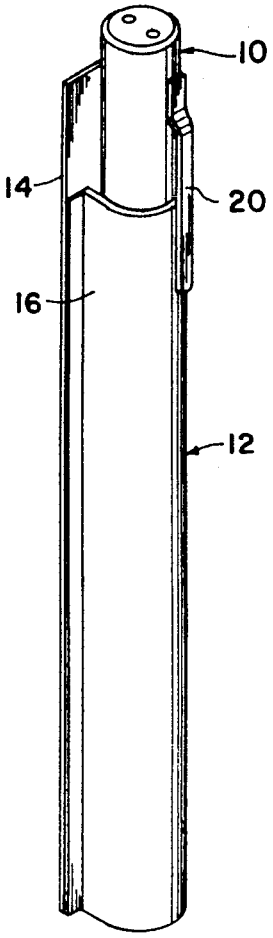
FIG. 1 is a perspective view of a fully assembled portable dental care unit in accordance with this invention.

There is shown in FIG. 1 a portable dental care appliance or unit 10 which is accommodated by a sheath 12 composed of fabric or other absorbent material. Sheath 12 includes an elongate, generally planar piece 14 and an elongate pocket 16 which is formed on one side of piece 14. Pocket 16 receives elongate unit 10, which is described in detail below. A spring clip 20 is attached proximate an upper end of unit 10. Clip 20 fits over the outside surface of pocket 16 and is biased against that surface to hold unit 10 securely in place within the pocket of sheath 12.

Figure 2:
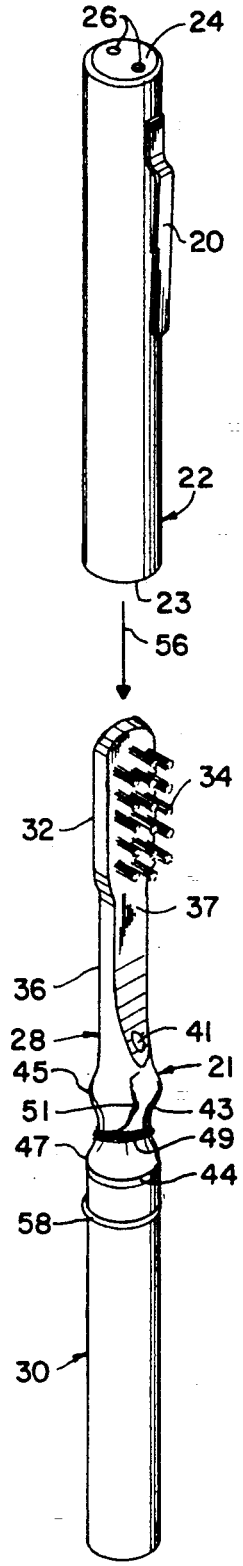
FIG. 2 is a perspective view of the toothbrush apparatus and the closure means for selectively covering that apparatus.

As illustrated in FIG. 2, the portable unit includes a toothbrush apparatus 21 and a generally cylindrical cap 22 which has an open lower end 23 and a generally closed upper end 24. A pair of ventilation orifices or openings 26 are formed in upper end 24. Spring clip 20 is secured to the outer wall of closure 22 and extends generally parallel to the axis thereof.

Figure 3:
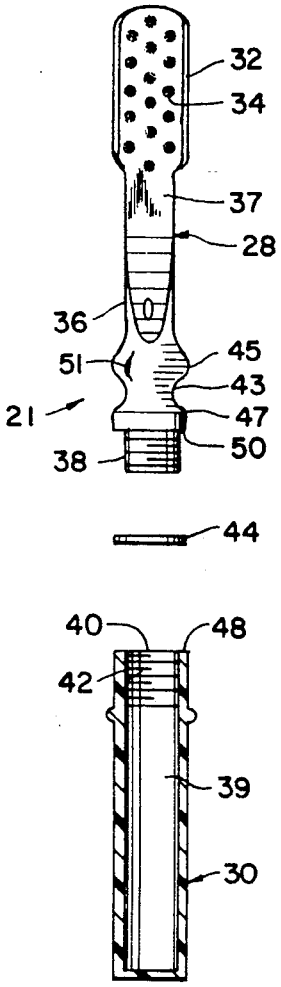
FIG. 3 is an exploded view of the toothbrush apparatus.

Toothbrush apparatus 21, an exploded view of which is shown in FIG. 3, includes an upper piece 28 and a lower piece 30 that are selectively interconnected as described below. Upper piece 28 includes a head portion 32 and preferably soft bristles 34 which extend laterally from head portion 32. An intermediate stem portion 36 is integrally connected to head 32 and extends downwardly therefrom. A generally cylindrical, peripherally threaded base portion 38 extends generally axially from the lower end of intermediate portion 36. Intermediate portion 36 also includes a recessed region 37 that is formed immediately beneath bristles 34. A slot 41 is formed in portion 36 proximate the lower end of region 37. This slot serves to accommodate a toothpaste container in a manner described more fully below in connection with FIG. 5A.

The intermediate portion 36 includes a generally hour-glass shaped portion below recessed region 37. This section includes upper and lower enlarged peripheral segments 45 and 47 which define the upper and lower boundaries of a spool region 43. A supply of dental floss 49 is wound peripherally about spool region 43. The outer end of the dental floss may be anchored in a notch 51 that is formed in portion 36 proximate the upper end of the spool region.

Lower piece 30 comprises a generally cylindrical member having a receptacle 39 and an open upper end 40 which forms an entrance into the receptacle. The inside wall of lower piece 30 includes threads 42 proximate upper end 40 for engaging the threaded base 38 of upper piece 28.

Figure 4:
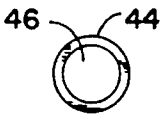
FIG. 4 is a plan view of an O-ring seal interposed between the upper and lower pieces of the toothbrush apparatus.

To attach the upper and lower pieces 28 and 30, the threaded base 38 is inserted into the open upper end 40, and the upper and lower pieces are turned to engage the threads on base 38 with the threads 42. An elastomeric O-ring seal 44, shown alone in FIG. 4, includes a central opening 46 which receives base 38. As a result, when base 38 is engaged with upper end 40, seal 44 is interposed between the rim 48 of lower piece 30 and the shoulder 50 on upper piece 28. As best shown in FIG. 2, O-ring 44 thereby forms a liquid-tight seal between the upper piece 28 and the lower piece 30. In this assembled condition, toothbrush apparatus 21 is ready for use in brushing the teeth. Lower piece 30 serves as the handle for the toothbrush apparatus.

To store or transport unit 10, the closure 22 is fit onto apparatus 21. More particularly, closure 22 is advanced in the direction of arrows 56, FIG. 2, so that the head portion 32 and bristles 34 of the toothbrush apparatus are received in closure 22 through lower opening 23. The closure is advanced onto toothbrush apparatus 21 until the rim of lower end 23 engages an integral, peripheral rib 58 that is formed on the outside wall of lower piece 30.

Figure 5A:
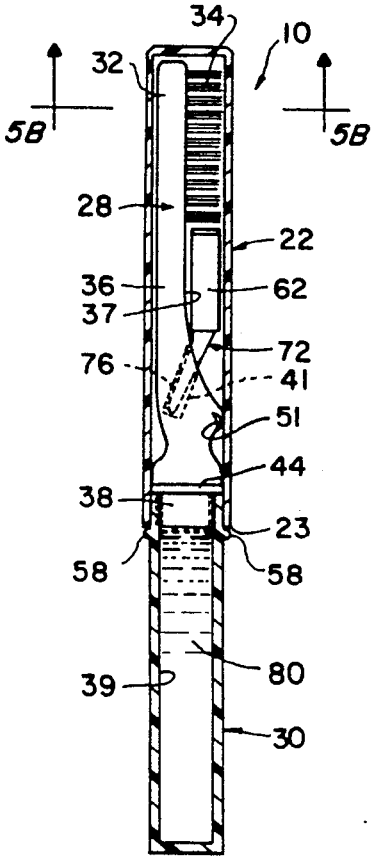
FIG. 5A is a cross sectional view of the dental care unit without the sheath.
Figure 5B:
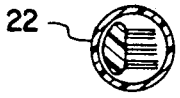
FIG. 5B is a cross sectional view taken along line *5b—5b* of FIG. 3A.

FIG. 5A illustrates unit 10 in the assembled, closed condition, ready for transportation and storage. Upper piece 28 of toothbrush apparatus 21 is threadably attached to lower piece 30. Closure 22 is fitted onto apparatus 21 so that the inner walls of the closure engage the outer surface of the upper end 40 of lower piece 30. The inside wall of closure 22 also slidably and snugly engages the enlarged segments 45 and 47 of intermediate stem portion 36. This assists in holding closure 22 firmly in place on toothbrush apparatus 21. In this condition the upper piece 28 of the toothbrush apparatus fits compactly within closure 22. As best shown in FIG. 5B, toothbrush head portion 32 includes a rounded cross-sectional shape which generally conforms to the inside cylindrical wall of the closure. The tips of the bristles also closely match the inside diameter of the closure so that very little space is wasted.

Figure 6:
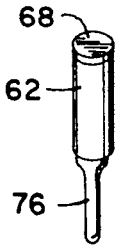
FIG. 6 is a perspective view of a preferred toothpaste container/plunger which may be employed in this invention.
Figure 7:
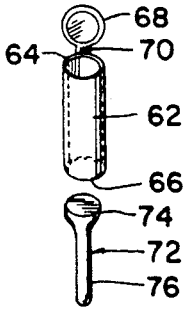
FIG. 7 is a perspective view of the toothpaste container and plunger with a cap on the container opened and the plunger removed for clarity.

Recessed region 37 accommodates a toothpaste container 62. As shown most clearly in FIGS. 6 and 7, container 62 has a generally cylindrical shape. The chamber of the container typically holds a small supply of toothpaste which may be used during a trip. Typically, this will comprise a single day's supply although other amounts may be utilized within the container. The container has open upper and lower ends 64 and 66. A cap 68 is attached to the upper end of container 62 by a flexible, integral hinge 70. A plunger 72 is disposed through the opposite end. Plunger 72 includes a plunger head 74 which is received within container 62, and an elongate stem or handle 76 which is attached to plunger head 74 and extends therefrom out the lower end 66 of container 62. Toothpaste is introduced into container 62 by opening cap 68 (allowing air pressure to be relieved) and adding the paste through the lower end of the container with the plunger removed.

Before apparatus 21 is assembled for travel, a second dentifrice, such as a mouthwash, rinse or gargle 80, FIG. 5A, is introduced into receptacle 39 of lower piece 30. Upper piece 28 is then releasably attached to lower piece 30 in the manner previously described. This closes open upper end 40, FIG. 3, of lower piece 30 so that rinse 80 is fully enclosed within receptacle 39. As shown in FIG. 5A, O-ring 44 prevents leakage of rinse 80 from the receptacle.

Stem 76 on plunger 72 is received by groove 41 at the lower end of recessed region 37. As a result, container 62 is held securely in place within the recessed region beneath bristles 34. This enables the space within unit 10 to be utilized in the most efficient manner during transportation and storage of the appliance.

Both the toothbrush apparatus 21 and the closure 22 may be constructed of various sturdy plastic materials. The upper piece 28 of the toothbrush apparatus may be molded in either a solid or a hollow construction.

Figure 8:
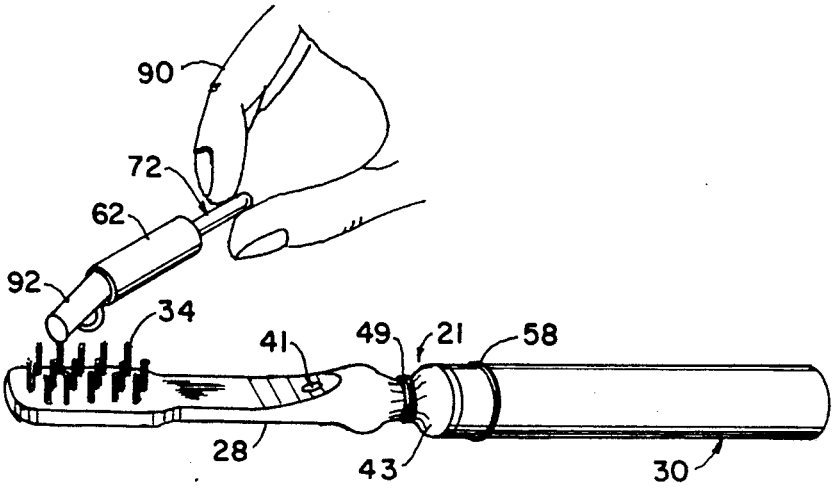
FIG. 8 is a perspective view of a user applying toothpaste from the container onto the toothbrush bristles of the portable dental care unit.

To employ apparatus 21 for brushing the teeth, closure 22 is removed from the toothbrush apparatus in the direction opposite to that depicted by arrows 56 in FIG. 2. Toothpaste container 62 is then removed from recessed region 37 by drawing plunger handle 76 out of slot 41. As shown in FIG. 8, the user 90 opens the cap on container 62 and positions the open upper end of the container proximate the bristles 34 of toothbrush apparatus 21. User 90 then pushes plunger 72 through the cylindrical container so that the plunger head forces toothpaste 92 out through the open upper end of container 62 and onto bristles 34. The user may then brush his or her teeth in a conventional manner.

The user may also gargle with the mouthwash or rinse 80 contained by receptacle 39 of lower piece 30. This is accomplished simply by unthreading base 38 from threads 42 so that the upper piece 28 is separated from the lower piece 30. As a result, receptacle 39 is exposed so that the user may gargle with the rinse 80 contained therein. If desired, the user may also employ some or all of the dental floss 49 which is wound about spool region 43. This floss is removed for use simply by detaching its outer end from the notch 51 and unwinding the floss in a standard manner from the spool.

Following use of unit 10 for brushing, rinsing and/or flossing, the appliance may be quickly and conveniently reassembled for transport or storage. First, the apparatus is rinsed thoroughly. Then, if necessary, the upper piece 28 is re-attached to the lower piece 30 in the manner previously described. Next, closure 22 is re-attached to apparatus 21 so that the toothbrush head 32 and bristles 34 are fully and hygienically covered and protected. Reassembled unit 10 may then be replaced in sheath 12. The unit may be carried within and clipped to the user's pocket, or placed in a travel bag or luggage. Holes 26, FIGS. 1 and 2, provide ventilation to the bristles and head of the toothbrush so that they dry more rapidly. Excess moisture which remains on unit 10 after it is used and rinsed may be absorbed by the material in sheath 12.

Accordingly, the present invention uniquely permits the traveler to carry two dentifrice (typically toothpaste and rinse) within a portable unit, at the same time. This is in contrast to prior art portable dental care units which carry only a single dentifrice at any one time. This invention therefor provides the traveler convenient access to various forms of dental care, including rinsing which has heretofore been unavailable with conventional travel units. This variety of care is improved even further by embodiments which include a supply of dental floss. Therein, typically three dental care products are carried by the unit at one time.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A portable dental care unit comprising:

a toothbrush apparatus, which includes an upper piece and a lower piece, said upper piece having a head portion and bristle means, which are attached to and extend generally laterally from said head portion, a base portion, which includes means for selectively attaching to complementary means on said lower piece such that said lower piece forms a handle for said toothbrush apparatus, and an intermediate portion integrally interconnecting said head portion and said base portion and including a recessed region formed below said bristle means, said lower piece further having a receptacle for accommodating a first dentifrice therein:

a container received by said recessed region for holding a second dentifrice therein; and closure means which are selectively engaged with said toothbrush apparatus for provisionally enclosing at least said head portion and said bristle means of said upper piece between uses; said intermediate portion including a spool region formed peripherally about said upper piece below said head portion for winding a supply of dental floss thereon and further including a pair of enlarged segments formed peripherally about said upper piece above and below said spool region for engaging the inside wall of said closure means when said closure means are engaged with said toothbrush apparatus.

2. A portable dental care unit comprising:

a toothbrush apparatus, which includes an upper piece and a lower piece, said upper piece having a head portion and bristle means, which are attached to and extend generally laterally from said head portion, a base portion, which includes means for selectively attaching to complementary means on said lower piece such that said lower piece forms a handle for said toothbrush apparatus, and an intermediate portion interconnecting portion and said base portion and including a recessed region formed below said bristle means, said lower piece further having a receptacle for accommodating a first dentifrice therein:

a container received by said recessed region for holding a second dentifrice therein; and closure means which are selectively engaged with said toothbrush apparatus for provisionally enclosing at least said head portion and said bristle means of said upper piece between uses; said container including a discharge portion and a chamber for accommodating a toothpaste and further including plunger means that are manually drivable through said chamber to urge the toothpaste out of said discharge portion onto said bristle means; said plunger means including a plunger head that is slidably receivable in said chamber and a handle portion that is attached to said plunger head portion and extends in a rearward direction out of said container; said handle portion being engaged to drive said plunger head through said chamber; said recessed region including slot means for receiving said handle portion of said plunger means to hold said container in place in said recessed region.

3. A portable dental care unit comprising:

a toothbrush apparatus, which includes an upper piece and a lower piece, said upper piece having a head portion and bristle means, which are attached to and extend generally laterally from said head portion, a base portion, which includes means for selectively attaching to complementary means on said lower piece such that said lower piece forms a handle for said toothbrush apparatus, and an intermediate portion interconnecting portion and said base portion and including a recessed region formed below said bristle means, said lower piece further having a receptacle for accommodating a first dentifrice therein:

a container received by said recessed region for holding a second dentifrice therein; and closure means which are selectively engaged with said toothbrush apparatus for provisionally enclosing at least said head portion and said bristle means of said upper piece between uses; said intermediate portion including a spool region formed peripherally about said upper piece below said head portion for winding a supply of dental floss thereon.

4. The device of claim 3 in which said upper piece includes notch means for securing one end of said floss therein.

5. The device of claim 3 in which said intermediate portion includes a pair of enlarged peripheral segments formed above and below said spool region for engaging the inside wall of said closure means when said closure means are engaged with said toothbrush apparatus.

6. The device of claim 3 in which said means for selectively attaching includes a first thread formed on said base, and said complementary means includes a second thread means formed on an upper end of said lower piece and being engagable with said first thread means to attach said lower piece to said upper piece.

7. The device of claim 3 in which said lower piece includes an open upper end for selectively receiving said base of said upper piece to attach said lower piece to said upper piece.

8. The device of claim 7 in which said base includes a first thread means formed peripherally thereon, and in which said open upper end includes second thread means formed therein for engaging said first thread means to attach said lower piece to said upper piece.

9. The device of claim 3 in which said closure means include an opening for receiving said upper piece, said lower piece including an upper end which is slidably receivable in said opening of said closure means to provisionally hold said closure means onto said toothbrush apparatus.

10. The device of claim 9 in which said lower piece includes rib means for engaging said closure means to limit advancement of said closure means onto said lower piece.

11. The device of claim 3 in which said recessed region includes means for releasably retaining said container therein.

12. The device of claim 3 in which said container includes a discharge portion and a chamber for accommodating a toothpaste, and wherein plunger means are manually drivable through said chamber to urge said toothpaste out said discharge portion onto said bristle means.

13. The device of claim 3 further including an absorbent sheath for holding said unit.

14. The device of claim 3 in which said closure means includes orifice means for providing ventilation to said head portion and said bristle means to assist in drying said toothbrush apparatus.

15. The device of claim 3 in which said first dentifrice includes a liquid substance and said receptacle includes a liquid holding compartment.

16. The device of claim 15 further including seal means comprising an O-ring seal disposed between said upper and lower pieces for restricting leakage of said first dentifrice from said receptacle.

17. A portable dental care unit comprising:

a toothbrush apparatus, which includes an upper piece and a lower piece, said upper piece having a head portion and bristle means, which are attached to and extend generally laterally from said head portion, a base portion, which includes means for selectively attaching to complementary means on said lower piece such that said lower piece forms a handle for said toothbrush apparatus, and an intermediate portion integrally interconnecting said head portion and said base portion and including a recessed region formed below said bristle means, said lower piece further having a receptacle for accommodating a first dentifrice therein:

a container received by said recessed region for holding a second dentifrice therein, said container including a discharge portion and a chamber for accommodating a toothpaste;

plunger means that are manually drivable through said chamber of said container to urge said toothpaste out of said discharge portion onto said bristle means; and closure means, which are selectively engaged with said toothbrush apparatus for provisionally enclosing at least said head portion and said bristle means of said upper piece between uses.

18. The device of claim 17 in which said plunger means include a plunger head that is slidably receivable in said chamber and a handle portion which is attached to said plunger head portion and extends out of said container in a rearward direction, said handle portion being engaged to drive said plunger head through said chamber.

19. The device of claim 18 in which said recessed region includes means for releasably retaining said container therein.

20. The device of claim 19 in which said means for releasably retaining include slot means for receiving said handle portion of said plunger means to hold said container in place in said recessed region.

* * * * *

UNITED STATES PATENT AND TRADEMARK OFFICE

CERTIFICATE OF CORRECTION

PATENT NO. : 5,044,386

DATED : Sep. 3, 1991

INVENTOR(S) : Gary H. Nelson

It is certified that error appears in the above-identified patent and that said Letters Patent is hereby corrected as shown below:

On the title page, item [76], change "Gary M. Nelson" to --Gary H. Nelson--.

Signed and Sealed this

Twenty-third Day of February, 1993

*Attest:*

STEPHEN G. KUNIN

*Attesting Officer*

*Acting Commissioner of Patents and Trademarks*